United States Patent [19]

Sjöstrand et al.

[11] 4,055,035

[45] Oct. 25, 1977

[54] METHOD AND AN ARRANGEMENT FOR THE PURIFICATION OF AIR IN PACKING MACHINES

[75] Inventors: Uno Roland Sjöstrand, Flyinge; Göran Karl Nils Johansson, Harlosa, both of Sweden

[73] Assignee: AB Ziristor, Lund, Sweden

[21] Appl. No.: 670,367

[22] Filed: Mar. 25, 1976

[30] Foreign Application Priority Data

Apr. 7, 1975 Sweden ..... 7503934

[51] Int. Cl.[2] ..... B65B 55/12

[52] U.S. Cl. ..... 53/167; 55/92; 55/267; 55/279; 55/385 R; 21/80; 21/93

[58] Field of Search ..... 55/87, 92, 237, 238, 55/257 C, 267, 279, 338, 385 R; 53/28, 167, 58; 21/78-80, 91-93; 118/65-67

[56] References Cited

U.S. PATENT DOCUMENTS

| | | | |
|---|---|---|---|
| 2,524,703 | 10/1950 | Hartman | 55/267 |
| 2,971,311 | 2/1961 | Messmer et al. | 53/167 |
| 3,383,831 | 5/1968 | Goldsmith | 53/167 |
| 3,692,468 | 9/1972 | Loliger et al. | 53/167 |
| 3,716,083 | 2/1973 | Tuma et al. | 53/167 |
| 3,789,569 | 2/1974 | Egger | 53/167 |
| 3,854,874 | 12/1974 | Loliger et al. | 53/167 |
| 3,911,642 | 10/1975 | Ernstsson | 53/167 |
| 3,989,461 | 11/1976 | Skocypec | 21/91 |

*Primary Examiner*—Frank W. Lutter
*Assistant Examiner*—David L. Lacey
*Attorney, Agent, or Firm*—Earle R. Marden; H. William Petry

[57] ABSTRACT

Method and apparatus to extract sterilized air and vapor from a packaging machine and the sterilizing agent is separated from the sterilized air and the sterilized air is recirculated to the packaging machine for further use.

2 Claims, 1 Drawing Figure

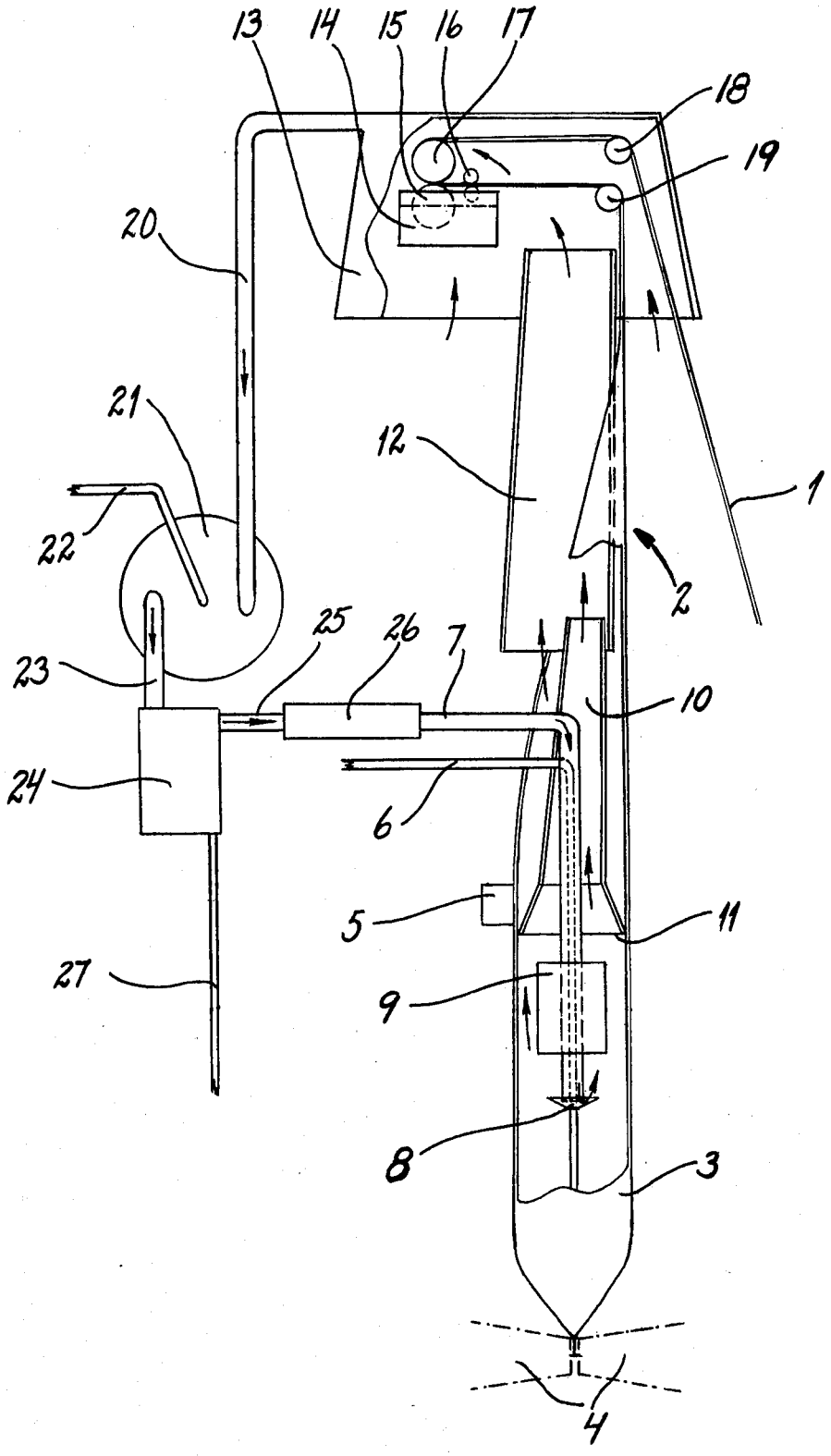
13
14
15
16
17
18
19
20
21
22
12
1
2
23
25
26
7
10
24
6
5
11
27
9
8
3
4

METHOD AND AN ARRANGEMENT FOR THE PURIFICATION OF AIR IN PACKING MACHINES

The present invention relates to a method for the purification of air mixed with sterilizing agent in the machine for the manufacture of sterile packages, in which machine a web of packing material is sterilized by a sterilizing agent in vapor or liquid form, which on completion of its sterilizing function is removed by means of a sterile air stream.

The invention also relates to an arrangement for the realization of the method in a packing machine of the type wherein a web of packing material, treated by means of a sterilizing agent is transformed into a tube whilst moving downwards through the machine, and is heated by means of a tube heater. It is then subjected to a stream of sterile air generated by means of a liquid ring compressor from air nozzle arranged in the packing material tube, is filled with the desired contents and is then transformed to individual packages.

Machines for the manufacture of disposable packages, for e.g. liquid foodstuffs, are known. Such a machine produces packages from a web of packing material which is fed to the upper end of the packing machine, where the web passes through a bath of sterilizing agent, usually hydrogen peroxide, whereafter the excess sterilizing agent is removed from the web by means of rollers. The packing material web thus treated with sterilizing agent is then made to pass downwards through the packing machine whilst being continuously transformed to a tube. After the longitudinal joint of the tube has been sealed, the tube is made to pass a so-called tube heater, arranged in the tube, which heats the inside of the tube material to a temperature at which the sterilizing agent vaporizes. With the help of an air nozzle, arranged underneath the tube heater, a sterile air stream is made to move in the opposite direction to the direction of movement of the tube, that is to say upwards through the tube in the direction toward its upper, open end. This sterile air stream entrains the vaporized sterilizing agent and prevents the same from reaching the lower end of the tube where the sterile contents are being introduced. After the contents have been introduced, the tube is pressed together in transverse zones situated at equal distances, in which the sealing, and afterwards the cutting of the tube into individual, filled packages takes place.

In the type of sterile packing machines described, the sterilizing agent was blended after use in vapor form with the sterile air stream introduced into the tube and was discharged through the upper, open end of the packing material tube. Since it is hardly desirable for the gas to be freely discharged in the dairy premises, it became necessary to place an exhaust arrangement above the packing machine, which arrangement takes charge of the majority of the gas and conducts it out to the atmosphere.

It is an object of the present invention to provide a method to take charge of the air mixed with sterilizing agent so that it is not discharged into the premises.

It is a further object of the present invention to provide a method so as to purify and reuse the air mixed with sterilizing agent.

These objects have been achieved in accordance with the invention in that a method of the type described in the beginning was given the characteristic that the air containing the sterilizing agent is passed through a liquid ring compressor of a known type, in which the sterilizing agent through the effect of centrifugal force is mixed with liquid, whereupon the purified air is separated from the liquid mixture and is returned to the packing machine.

It is a further object of the present invention to provide an arrangement for the realization of the method described above, and such an arrangement for use in a packing machine of the type described in the beginning was given the characteristic that the air inlet of the liquid ring compressor is connected to a system of hoods located in the upper part of the packing machine for the collection of the air mixed with sterilizing agent flowing upwards through the packing material tube, and that the outlet opening of the liquid ring compressor is connected via a liquid separator and is arranged to conduct compressed air to the air nozzle located in the material tube.

In the following the invention will be described with reference to the enclosed drawing, which schematically shows an embodiment of the method and the arrangement in accordance with the invention in a sterile packing machine of a known type.

In the drawing, which only shows the parts necessary for the understanding of the invention, a packing material web is indicated by referencenumber 1. The packing material web 1 is successively transformed in the area indicated by 2 to a packing material tube 3, the outer end of which, with the help of sealing and cutting jaws 4, is divided into separate, filled packages, An arrangement for the sealing of the longitudinal joint of the packing material tube 3 is indicated by reference number 5, and above this extends a filling pipe 6 for the contents, together with a supply pipe 7 for sterile air into the packing material tube 3. The pipe 7 extends concentrically in relation to the pipe 6 down through the packing material tube 3 and ends in a so-called jet deflector 8. The supply pipe 6 for the contents extends past the jet deflector 8 and ends at some distance above the sealing jaws 4. Above the jet deflector 8, the two pipes 6 and 7 are surrounded by a heating unit, a so-called tube heater 9. Above the tube heater 9 is a tubular hood 10 located in the tube 3, the lower end of which is conically expanded so that the lower edge 11 of the hood 10 is in contact with the inside of the packing material tube 3. The upper end of the hood 10 ends in a further hood 12, which is located in the region 2 in which the packing material web 1 is transformed to tubular shape. The hood 12, which is partly surrounded by the packing material web being transformed into a tubular shape, has a larger hood 13 arranged above the packing machine, which also surrounds an application arrangement for sterilizing liquid located at the upper end of the packing machine. The application arrangement comprises a container 14 filled with sterilizing agent, an application roller 15, a pressure roller unit 16, a counter roller 17, guide rollers 18 and 19. From the hood 13 a duct 20 leads to a liquid ring compressor 21, which is of a known type and thus operates with a circulating liquid ring as a sealing medium. The sealing liquid which is preferably water, is supplied via a pipe 22. The outlet opening of the liquid ring compressor 21 is connected via a pipe 23 to a liquid separator 24, from which a pipe 25 via a sterile air heater 26 is connected to the supply pipe 7 of sterile air. From the liquid separator 24 a pipe 27 also conducts liquid away to the drain or the like.

During the operation of the machine the packing material web 1 is passed from a magazine roll (not shown) underneath the hood 13 at the upper end of the packing machine. In the hood 13 the material web 1 is conducted with the help of the rollers 16–19 in such a manner that the side of the packing material, which subsequently will form the inside of the packages, will be in contact with the application roller 15 for sterilizing liquid, which roller is freely rotatable and partly immersed in the sterilizing liquid present in the tank 14. After excess sterilizing liquid has been removed from the packing material web 1 with the help of the pressure roller unit 16, the packing material web is conducted substantially vertically downwards through the machine and is shaped continuously, in that its two longitudinal edges are made to close together, which takes place in the region marked 2. At the end of this region the longitudinal edges of the packing material web 1 have been made to overlap each other somewhat, and the edges are now sealed to one another with the help of the sealing arrangement 5 so that the tube 3 provided with longitudinal joint is obtained. The completed tube 3, which is still webbed with sterilizing agent, is then heated with the help of the tube heater 9 to such a temperature that the sterilizing agent present on the inside wall surface of the packing material tube 3 is vaporized. To prevent the vaporized sterilizing agent from coming into contact with the contents present at the bottom end of the packing material, tube 8 is heated, sterile air is blown in via the pipe 7 which ends in the jet deflector 8 a little below the tube heater 9. By this an upwards directed air stream is created, which flows long the wall of the material tube 3 past the tube heater 9 and into the hood 10, whose lower edge 11 is almost completely in contact with the inside wall surface of the tube 3. The upper end of the hood 10 ends in the hood 12 located above, which is situated in the region 2 within which the web 1 of packing material is transformed to tubular shape, and which partly extends into the curved material track. The hood 12 has such a shape that it collects the gas flowing through the hood 10 as well as any gas leaking out through the not yet sealed longitudinal joint of the tube 3 and conducts the gas upwards to the hood 13 located above the machine.

From the hood 13 the air mixed with sterilizing agent is sucked via the duct 20 to the liquid ring compressor 21. Sealing liquid is supplied via the pipe 22 to the liquid ring compressor 21 and by the centrifugal force, created through the rotation of the compressor rotor, the sterilizing agent, present in the air that has been introduced, will be flung outwards and mixed with the sealing liquid. Since the sealing liquid is relatively cold (approx. 20° C or lower) a condensation of the sterilizing agent will also take place which contributes to an optimization of the purifying effect. The purified air and a part of the sealing liquid subsequently leave the compressor and are conducted via the pipe 23 to a separator 24, in which the liquid is separated and is removed via the pipe 27. The purified air, freed from sealing liquid and sterilizing agent, is conducted from the separator 24 via the line 25 to the sterile air heater 26, by means of which the air is heated to the desired temperature before being re-introduced into the packing material tube 3 for renewed application.

The method described for making use of a liquid ring compressor not only for generating the necessary air pressure, but also for purifying the air from sterilizing agent, entails also a strong reduction of the bacteria, content of the air, since the bacteria like the remainder of the sterilizing agent, are affected by the centrifugal force and are mixed with sealing liquid. This purification is so effective, that previously used air filter and the like can be completely dispensed with.

By the method and the arrangement in accordance with the invention for the re-using and purification of contaminated air, a system is obtained which, by virtue of its small size and simplicity can be applied directly on any packing machine. Accordingly it is no longer necessary to arrange any special ventilation or extraction system for contaminated air from the space around the packing machine, which means simpler ventilation of the premises.

That which is claimed is

1. A method for the purification of air mixed with a sterilizing agent in a machine for the manufacture of sterile packages in which a web of packaging material is sterilized by a sterilizing agent in vapor or liquid form comprising the steps of removing sterilized air mixed with a sterilizing agent from the packaging machine, supplying the sterilized air mixed with the sterilizing agent to a liquid sealed centrifugal compressor, mixing the sterilizing agent with the sealing liquid of the compressor while separating the sterilized air therefrom, removing the sterilized air and any entrained sealing liquid from the compressor, separating the entrained liquid from the sterilized air and returning the sterilized air to the packaging machine for reuse.

2. Apparatus to package a product in a sterile container comprising means to supply a web of material, means to apply a sterilizing material on said web of material, means to form said web of material into a tube, means to supply filling material into said tube, means to form a filled package, heater means inside the tube to vaporize the sterilizing material on the web of material, means to supply sterile air into the tube of material below said heater means, means to deflect the sterile air upwardly to mix with the vaporized sterilizing material, hood means to collect the mix of sterile air and vaporized sterilizing material, a liquid sealed compressor means to separate and condense the sterilizing material from the sterile air, means to supply the mix of sterile air and vaporized material from said hood means to said compressor means and separation means connected to said compressor means to separate entrained sealing liquid and means to return the sterile air to said sterile air supply means.

* * * * *

UNITED STATES PATENT OFFICE

CERTIFICATE OF CORRECTION

Patent No. 4,055,035 Dated October 25, 1977

Inventor(s) Uno Roland Sjostrand et al

It is certified that error appears in the above-identified patent and that said Letters Patent are hereby corrected as shown below:

Column 2, line 27, delete the word "outer" and substitute therefor --lower--.

Column 3, line 27, delete the numeral "8" and substitute therefor --3--.

Column 3, line 31, delete the word "long" and substitute therefor --along--.

Column 4, line 53, insert the word --sterilizing-- between "vaporized" and "material".

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*